United States Patent [19]

Schwartz

[11] 4,103,266

[45] Jul. 25, 1978

[54] COOLED LIFTING MAGNET WITH DAMPED EDDY CURRENTS AND METHOD FOR ITS FABRICATION

[76] Inventor: Charles A. Schwartz, 23366 Commerce Park, Beachwood, Ohio 49122

[21] Appl. No.: 720,256

[22] Filed: Sep. 3, 1976

[51] Int. Cl.[2] ..... H01F 7/20

[52] U.S. Cl. ..... 335/289; 335/294

[58] Field of Search ..... 335/289, 291, 294, 285; 294/65.5; 336/65, 83

[56] References Cited

U.S. PATENT DOCUMENTS

| | | | |
|---|---|---|---|
| 2,479,248 | 8/1949 | Moore et al. | 335/294 |
| 2,511,693 | 6/1950 | Burghoff | 336/65 |
| 3,054,026 | 9/1962 | Lovell | 335/244 |
| 3,693,126 | 9/1972 | Rybak | 335/291 |
| 3,891,953 | 6/1975 | Thomin | 335/289 |

*Primary Examiner*—Harold Broome
*Attorney, Agent, or Firm*—Alfred D. Lobo

[57] ABSTRACT

A cooled magnet is disclosed for lifting magnetic materials with incident savings in the cost of energy. The magnet comprises a dome-shaped metal case open to the atmosphere under the case, and, for producing a magnetic field, a continuous hollow conductor electrical winding removably disposed on a central core within the metal case. The metal case and central core are each provided with a radial slot in a vertical plane to inhibit the build-up of eddy currents. The hollow conductor offers an electrically continuous path, but is preferably so constructed as to provide a fluid discontinuous path for a cooling medium circulated within the hollow conductor.

The dome-shaped metal case includes an inverted dished housing and a reinforcing cap member. The dished housing and cap member are fabricated from plural arcuate steel shells of predetermined configuration, superposed and nested one upon another in unimpeded magnetic communication with the central core. A metal case so fabricated permits surprising efficiency in design for maximum lifting capacity and avoids conventional casting and machining of the case.

The electrical winding is wound in plural cylindrical helical coils, one overlying the other radially outwardly, on a hollow cylindrical mandrel which is removably disposed on the central core. The space occupied by the winding and central core is less than 25 percent of the space within the dome-shaped metal case. The remaining 75 percent or more of the space, allows scrap fragments to be held within the metal case thus increasing the total lifting capacity of the magnet.

9 Claims, 5 Drawing Figures

COOLED LIFTING MAGNET WITH DAMPED EDDY CURRENTS AND METHOD FOR ITS FABRICATION

BACKGROUND OF THE INVENTION

Lifting magnets have been in common use for the past several decades and have become the accepted manner of handling all types of magnetic materials. The lifting capacity of any electromagnet is directly related to the ampere-turns of its coil. It makes no difference, magnetically, if there is one or a multiplicity of turns in the coil. As long as the number of turns multiplied by the number of amperes (amps) equals a particular product, one achieves the same magnetic force. For practical considerations magnets have been made with many turns, generally several thousand, and relatively low amperage, usually less than 100 amps. This choice of multiplicants results in an ampere-turn product sufficient for conventional use and permits the use of a flexible electrical conductor of convenient size to supply the necessary power.

The necessity of cooling an electrical coil used in energizing extremely powerful electromagnets of the type utilized in charged particle accelerators, has long been recognized. An example of such an electrical coil is described in U.S. Pat. No. 3,056,071 to Baker et al. Current requirements in such magnets are extremely high, being several orders of magnitude greater than that used in a scrap yard. Moreover accelerator electromagnets are not portable, at least in the sense that they may be suspended from the end of a cable on a crane, and they are unsuited to absorb the punishment to which a lifting magnet in a scrap yard is subjected.

The present invention is directed to electromagnets, such as are used in scrap yards, to lift quantities of relatively small steel pieces from a scrap pile and drop the pieces into a hopper car, comminutor, or the like. It is specifically designed to provide superior penetration into a pile of scrap, that is, pick up a deeper load than conventional lifting magnets. Superior penetration is possible because of the vacant space within the dome-shaped metal case in which scrap pieces can be held. Recognizing that much energy is wasted when there is air-space in a load, it is desirable to pack scrap more densely into the magnet case not only to increase the load picked up on each cycle, but also to increase the electrical and magnetic efficiency with which the load is picked up.

Conventional lifting magnets have a metal case within which the electrical winding is disposed. A typical metal case, as illustrated in U.S. Pat. No. 3,693,126 is cast and machined and includes flanges, usable for attaching the magnet to a lifting means, which flanges are an integral part of the metal case. The metal case also includes a central core and a bottom plate on which the electrical winding rests. Fabricating the central core to accomodate the bottom plate and machining the metal case so that all the structural components provide a hermetical seal for the electrical winding enclosed within the metal case, is arduous and expensive, requiring extensive machining. My invention provides a dome-shaped metal case fabricated from plural nested arcuate steel shells superposed one upon another in magnetic communication with a central core to form a unitary outer pole shoe which requires essentially no machining.

Typically, a scrap lifting electromagnet is operated by placing the electromagnet on a pile of scrap then energizing the coil, lifting the scrap held to the magnet, transporting the scrap to a desired location, and turning off the current to the coil so as to release the scrap. A conventional lifting magnet with the coil sealed in the metal case by a coil support plate, rests on top of a pile of scrap and the only penetration for load pickup is that generated by the magnetic field of the coil. The hollow metal case of this invention permits physical penetration of the central core and coil into a pile of scrap, before the coil is energized, thus packing scrap into the hollow case. When the coil is energized, additional scrap is attracted to and around the coil, further packing scrap into the hollow case and increasing the density of packed scrap material to increase lifting efficiency. Lifting efficiency is of less significance for lifting stacked steel plates and tightly coiled strip steel in a steel mill because, unlike for scrap of random shape and size, the air-space is relatively small. Of greater consequence in a steel mill is providing the coil of a conventional magnet with thermal protection against heat dissipated by hot steel lifted by the magnet.

U.S. Pat. No. 3,693,126 is particularly directed to handling hot steel plates which might attain a temperature as high as 1100° F. As pointed out therein, one critical factor limiting the ability of an electromagnet to operate while lifting magnetic materials at such a high temperature, is the extent to which the electrical insulation of the magnet coil can withstand damage or deterioration due to the heat. To solve this problem, the reference teaches (a) a cooling medium in a coil encasing the winding, (b) circulating a cooling medium flowed over a conventionally wound solid wire electrical conductor to permit more efficient cooling of the winding due to direct contact of the cooling medium with the surface of the winding, and (c) a cooling medium in a cooling coil disposed within the electrical winding. This solution to the problem avoids damage to the insulation of the conductor due to the hot magnetic material being lifted, but it does nothing to increase the efficacy of the magnet, or to damp the buildup of eddy currents when high amperage is used. Water or coolant is not flowed through the bore of a hollow electrical conductor. The purpose of the coolant is solely to provide a thermal barrier for the insulation of a conventionally wound coil for a lifting magnet.

The importance of the effect of heat in the design of an electromagnet has been discussed in numerous publications, for example, in Knowlton's Standard Handbook for Electrical Engineers 8th Edition, Section 5, pages 182–190, but no practical solution has been provided for dissipation of the heat and simultaneous damping of the eddy currents generated due to high amperage.

A common means for cooling large high current coils uses the forced coolant technique. In this method a coil is wound of hollow conductor and a coolant is circulated through the axial passage of the conductor. One problem lies in efficiently forcing a coolant through the extremely long, restricted and curved coil passage. As stated in U.S. Pat. No. 3,056,071, if the hollow conductor is constructed with a large diameter cross-section, in order to reduce the pumping pressure required, the coil is resultingly less compactly wound, that is, has fewer turns per cross-sectional area, with deleterious results from the electrical standpoint. The overwhelming importance of having a hollow conductor through which coolant may be pumped under practical conditions, dictates that these deleterious results must be avoided. Accordingly, U.S. Pat. No. 3,056,071 teaches replacing the conventional hollow, tubular conductor with a flat strip of conductor wound in a tight spiral. One surface of the conductor is scored with parallel transverse grooves which constitute, when the conductor is wound into spiral form, a plurality of short longitudinal coolant passages distributed uniformly throughout the coil. To provide insulation between adjacent turns of the coil, a matching flat sheet of suitable dielectric material is wound with the conductor. Coolant liquid is easily pumped through the short parallel coolant channels of the coil, and in passing therethrough exteriorly of the conductor, effects an excellent heat transfer.

U.S. Pat. No. 3,693,126 to Rybak recognized that short longitudinal coolant flow described in U.S. Pat. No. 3,056,071 permits pumping a large volume of coolant in a single stream through the coil, but also recognized that this structure was unsuited to the continual impact to which a lifting magnet is subjected. Rybak therefore surrounded an electrical winding of solid conductor with a fluid-cooled jacket, and in one embodiment placed tubular cooling coils immediately adjacent and in heat-conducting relationship with the electrical winding. In so doing he effected no saving in the mass of electrical winding conventionally used for a preselected purpose, but added to the weight of the lifting magnet. This was consisent with solution of the particular problem of keeping a conventional lifting magnet cool, rather than the problem of saving weight in the magnet, and effecting a substitution of scrap payload for the weight savings. By substituting an internally cooled winding for a conventional winding a weight saving is effected which is of comparable importance to the weight saving effected by substituting a fabricated metal case for a cast case.

This is better understood by noting that consideration of weight recognizes that a crane has a specified lifting capacity which is the combined sum of magnet weight and scrap payload, irrespective of the distribution of each component. The desirability of maximizing scrap payload and minimizing magnet weight to increase lifting efficiency, is one of the problems to which this invention is directed.

In the past, both the weight of the metal case and that of the coil of an electromagnet were assumed to be immutable factors in the construction of lifting magnets. To be sure, various shapes of metal cases have been fabricated for particular purposes, as for example in U.S. Pat. No. 3,283,278, but the concept of substituting a metal case fabricated from plural arcuate nested shells, for a monolithic casting, eluded the prior art. Notwithstanding the lack of inventive faculty normally ascribed to making a substitution of any kind, for whatever purpose, it is a fact that it is not apparent that a fabricated metal case permits precisely tailoring the case for a particular magnetic field, thus avoiding the use of unnecessary material; and, suprisingly, the ease of forming rolled laminar steel sheets, and welding them along the periphery in nested relationship, contributes unexpected economies over casting and machining a housing, both in manufacture and in repair and maintenance. Whatever the reasons that the substitution was not disclosed in the prior art, it is now established that the fabricated metal case (a) is from about 20 percent to about 80 percent less in weight than a cast case for an electrical coil of preselected performance; (b) avoids the difficulties, risks and capital expenditures which attend the production of a large casting; and, (c) permits dents and breaks resulting from the rough treatment to which scrap yard lifting magnets are subjected, to be easily repaired.

Though weight of a lifting magnet is a key factor, lifting efficiency also depends upon the cycle time required to pick up, lift and drop off a load of magnetic material. Thus, for example where a lifting magnet is used as in a scrap yard, to pick up and release scrap metal, this cycle being repeated continuously throughout the working day, both the amount of scrap which may be picked up by the magnet and the rate at which it may be transferred are limited by the design of the electromagnet. As of the present time, to the best of my knowledge, no one has utilized a slotted case and central core structure in which eddy current effects are damped, nor has the concept of utilizing plural arcuate sheels, nested one with another to provide a magnet case, been utilized to house a hollow electrically continuous conduit in which the cooling fluid path is discontinuous. By the term discontinuous is meant that plural fluid paths are provided for cooling the coil, any one of which may be blocked without interfering with the fluid flow through the others.

Finally, electrical coils used for energizing extremely powerful electromagnets of the type utilized in charged particle accelerators, particularly where such magnets are of the pulsed variety, do not have an iron case or central iron core because the magnetic fields are generally in excess of that required to saturate iron. Since there is no iron case or core the problem of eddy current buildup is not a serious consideration even if the field is turned on and off numerous times. In a large lifting magnet for scrap, however, eddy current buildup is so significant that it may be 15 seconds, after the current is turned on, before the magnet can pick up its load; and another 15 seconds, after the current is turned off, before the magnet can drop the load.

SUMMARY OF THE INVENTION

It has been discovered that the metal case of a lifting electromagnet may be fabricated from plural arcuate shells of predetermined thickness, each shell nested one upon another to form a dome-shaped metal case. The dome-shaped metal case comprises a dished housing which may be structurally and magnetically reinforced by a cap comprising plural cap elements nested one upon another and attached to the central outer portion of the dished housing. The dished housing and the cap together are in unimpeded magnetic communication with a central core of magnetic material.

It is therefore a general object of this invention to solve the problem of minimizing the weight of a lifting magnet's case by substituting a fabricated case of plural arcuate shells in nesting relationship with each other, for a conventional cast case.

It has also been discovered that both weight and space may be saved in a lifting magnet by utilizing relatively few turns of a hollow conductor through which a coolant is flowed. Space saved is available for packing scrap.

It is therefore a general object of this invention to provide a new and improved lifting electromagnet with relatively few turns per coil, but utilizing high amperage which generates heat within the coil, which coil has low mass and occupies a minor portion of the volume of the magnet's case.

It is also a general object of this invention to provide a lifting magnet with an electrical winding of an internally cooled hollow conductor on a central core, which winding and core together occupy less than 25% of the internal volume of the magnet's case.

It has further been discovered that a fabricated, dome-shaped metal case and central metal core of a lifting magnet may be provided with a radial through-passage or slot which impedes the build up of eddy currents and decreases the cycle time of a lifting magnet, without impairing the magnet structurally.

It is therefore a general object of this invention to provide a fabricated dome-shaped metal case and central metal core with a radial slot, the slot extending from near the longitudinal axis of the core to near the periphery of the dome-shaped case.

It has been still further discovered that an electrical hollow conductor through which a coolant may be flowed, may be wound in plural cylindrical helical coils on a hollow cylindrical mandrel or spool which is removably disposed on the central core of a lifting magnet to permit replacement of the coil in the scrap yard.

It is therefore a general object of this invention to provide a low cost electrical coil removably disposed on the central core to minimize replacment cost.

It is a further general object of this invention to provide economies in energy costs which economies may be effected by tailoring current supply to the magnet during the operating portion of the cycle wherein the initial portion of the cycle utilizes a large current for a short period of time to secure the load to the magnet, which current is then decreased simply to carry the load from one location to another, and which current is then optionally reversed in direction to drop the load more quickly than if the current is simply shut off.

It is a specific object of this invention to provide a process for lifting ferromagnetic scrap material with an electromagnet comprising placing the electromagnet on a pile of the scrap with no current supplied to the ectromagnet, then generating an initial relatively large magnetomotive force for a short period of time from about 5 to about 30 seconds by supplying the electromagnet with sufficient currents to attract a portion of the scrap for a load; the initial magnetomotive force is from about 2 to about 10 times greater than the magnetomotive force required to maintain the load suspended in air; the load is then lifted from the pile of scrap and the magnetomotive force immediately reduced to a level just sufficient to hold the load suspended in air; the load is transported to a location where it is dumped by cutting off the current which maintains the magnetomotive force just sufficient to hold the load suspended in air (also sometimes referred to as "holding magnetomotive force").

These and other objects of the invention will be apparent from the following more detailed description of the drawings and the embodiments disclosed herein.

BRIEF DESCRIPTION OF THE DRAWINGS

The invention will be more fully described in connection with the accompanying drawings of preferred embodiments of the invention, wherein like reference characters refer to the same or similar parts throughout the several views, and in which.

DETAILED DESCRIPTION OF PREFERRED EMBODIMENTS OF THE INVENTION

As has been stated, the problem of weight in a lifting magnet is of overriding importance because the lifting capacity of a crane is limited and well-defined. For any particular crane, the more the lifting magnet weighs, the less is the material it can pick up. Since a lifting magnet comprises an electrical coil disposed within a metal case, with the coil supported on a support plate, any effort to reduce weight is necessarily directed to one or more of these structural components. Little effort has been directed to reducing the weight of any of these components simply because long usage dictated a coil of solid copper or aluminum wire conductor, wound several thousand times around a cast steel core in a cast metal case, for use with a power source supplying 250 volts at about the 24 Kilowatt (KW) power level of direct current. In a conventional lifting magnet, the metal case, including the central core, is conventionally cast, the electrical coil is disposed around the central core, and a non-magnetic support plate for the coil is fitted in the annular space between the central core and metal case, to seal the coil within the case. The weight of the support plate is related to it's thickness, which is specified chiefly to withstand the repeated impacts of the magnet on a pile of pieces of scrap material.

In a conventional lifting magnet, such as just described, the combined weight of the support plate and coil may be as much, or greater than the weight of the metal case. Nevertheless, a fabricated metal case can effect a weight saving of from about 10 percent to about 50 percent of the weight of a conventional, cast metal case. In a large magnet having a metal case diameter in excess of four feet, this saving in the weight of the magnet's case permits a corresponding increase in the payload of scrap the magnet can carry on each lift. Even a 10 percent increase in payload, over several thousand cycles, amounts to a substantial economic incentive.

Figure 1:
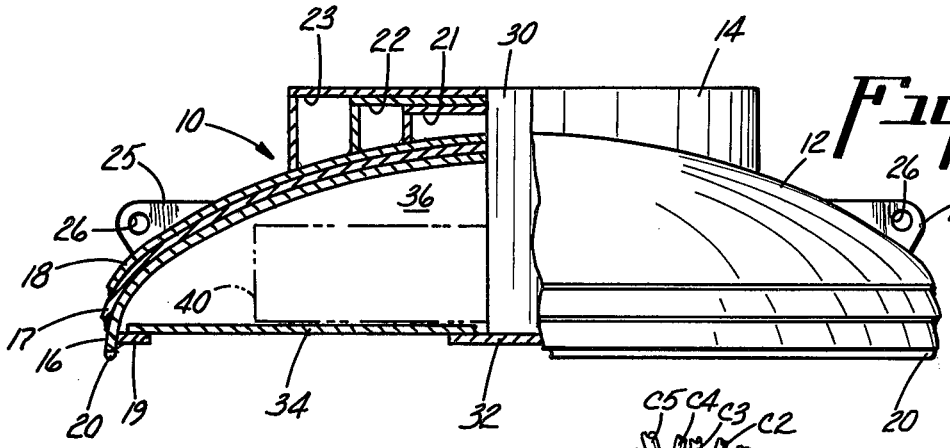
FIG. 1 is a front elevational view, partially in cross-section, in which is diagrammatically illustrated a fabricated dome-shaped metal case in which is housed a conventional electrical coil sealed in the case.

Referring now to the drawing, wherein like reference numerals refer to like elements, FIG. 1 diagrammatically illustrates in a partial cross-sectional side elevation, the lifting device of this invention which is provided with a fabricated, dome-shaped metal case, indicated generally by reference numeral 10. The metal case 10 includes plural arcuate metal shells of predetermined configuration, some of which are combined to form a dish-shaped housing, hereinafter referred to simply as a dished housing 12, and others are combined to form a cap member 14. The individual metal shells of the dished disclosed housing are identified by reference numerals 16, 17 and 18, and the individual metal shells of the cap member are identified by reference numerals 21, 22 and 23. All the metal shells are formed from laminar sections of mild steel which has been rolled to a uniform thickness. The thickness of each section is chosen in accordance with the magnetic requirements of the lifting magnet, and the capability of equipment available to form the shells into the desired shape.

The dished housing 12 may be of any predetermined size chosen in accordance with the design capacity of the lifting magnet of which it is to be a part, and is generally of a circular bowl shape, the nominal diameter of the dished housing being that of the innermost shell 16. If it is desired to utilize a support plate 34, as for example in a conventional scrap yard lifting magnet, a ledge 19 is provided on the inner surface of the innermost shell 16, near its periphery. Typically the dished housing includes, in addition, an outermost shell 18, and at least one intermediate shell 17. The circumferential rim of the outermost shell 16 is desirably provided with a wear-resistant coating, for example by welding a bead 20 of wear-resistant alloy commonly used for this purpose. The number of shells utilized is determined by the strength requirements for the dished housing, and the intensity of the magnetic flux to be generated. The cross section of shell material is approxiamtely inversely proportional to the radius of the metal case of the magnet so that, to keep the flux intensity approximately constant, maximum thickness is provided near the center, and minimum thickness near the periphery.

It will be recognized that each of the individual shells 16, 17 and 18 are in nesting relationship, one with another. Each shell is symmetrically disposed about the longitudinal axis, a shell of smaller diameter resting on one of larger diameter so that the periphery of the smaller shell may be welded to the upper surface of the larger shell, or fastened thereto so as to place the shells in unimpeded magnetic communication one with another. By unimpeded magnetic communication is meant that lines of magnetic flux may be established through the periphery of the smaller shell and into the larger shell without being substantially obstructed.

A nesting relationship of dished shells may be conveniently obtained by utilizing readily available tank heads such as are used for heads or ends on storage vessels. These tank heads are available as high crown, non-code or elliptical dished heads, the depth of each being different. As illustrated in FIG. 1 a series of elliptical dished heads (say) may be chosen, which rest closely one upon another with little space between successive shells. However, such a closely nested relationship is not essential because the lines of magnetic flux are not affected by the space between shells but by the effective cross sectional area of the superposed shells.

It will also be recognized that, though the dished shells are illustrated in FIG. 1 with the innermost shell having the largest diameter, and the outermost shell the smallest, the dished housing 12 may be constructed in reverse, namely with the outermost shell having the largest diameter and the innermost shell having the smallest. The sequence is immaterial, the choice depending upon the practical exigency of positioning the shells and fastening them together to form a magnetically and structurally unitary dished housing.

The cap member 14 is sized in accordance with the design capacity of the lifting magnet of which it is to be a part, and is generally of circular shape. The cap member 14 reinforces the dished housing 12 both structurally and magnetically. Typically the cap member includes an innermost cap shell 21, and outermost cap shell 23, and at least one intermediate cap shell 22. The number of shells utilized is determined by the strength requirements of the cap member, and the desirablity to maintain a constant magnetic flux density per unit cross-sectional area of shell. Since the flux is greatest near the center, maximum thickness is provided there; since the flux is least near the periphery of the cap member, minimum thickness is provided there, the thickness of the outermost shell being sufficient.

It will be recognized that each of the individual cap shells, 21, 22 and 23 are in nesting relationship, one with another. Each cap shell is symmetrically disposed about the longitudinal axis, a shell of larger diameter resting on one of smaller diameter. The periphery of each cap shell is fastened to the upper surface of the dished housing 12, preferably by welding, so as to place the cap shells in unimpeded magnetic communication one with another, and with the dished housing on which they are fastened.

A nesting relationship of cap shells to form the cap member may be conveniently obtained by utilizing preselected hollow cylindrical elements having flat tops. These hollow cylindrical elements are preferably fabricated by welding a laminar disc to a cylindrical section. As illustrated in FIG. 1 the cap shells are tightly nested with little or no space between superposed tops of cap shells, but the vertical spacing therebetween is not critical as long as sufficient steel is present to make use of the magnetic flux to be generated.

It will also be recognized that the precise geometrical shape of individual cap shells is not critical, provided the cap member formed therefrom, structurally and magnetically reinforces the dished housing, assuming such reinforcement is necessary. For example the cap shells may be smoothly arcuate dished shells which are shallow, that is, wherein the radius of the dished portion is large, but such shells are not as easily formed as are the hollow cylindrical cap shells illustrated.

The dished housing 12 is provided with plural lifting flanges 25, having through passages 26 therein, usable for attaching the dished housing to a lifting means, such as a crane's (not shown) hook or lifting boom.

The dome shaped metal case 10 is provided with a solid steel central core 30 around which a conventional electrical coil 40 (shown in phantom outline) is disposed. For practical reasons it is desirable to provide each of the arcuate shells of the dished housing and cap member with an axial passage through which the central core 30 is inserted, each shell being welded to the central core. Alternatively, where no axial passage is provided in the arcuate shells, the solid steel central core may be welded to the inner surface of the innermost shell 16, preferably with the core axially aligned with the shells. The central core 30 is fitted with a pole shoe 32 which lies in a horizontal plane, essentially coplanarly with the ledge 19 on the inside of innermost dished shell 16. A support plate 34 rests with its periphery on ledge 19 and its inner edge resting on pole shoe 32. The support plate 34 is a laminar disc of metal, having a central aperture of diameter larger than the diameter of the central core but smaller than the diameter of the pole shoe 32, and may be fastened both to the ledge 19 and to the pole shoe 32 to provide a conventional sealed enclosure 36 within the dished housing 12.

As in conventional lifting magnets, the sealed enclosure 36 encloses the electrical coil 40 which rests on support plate 34. The sealed enclosure protects the coil from water and dirt. Electrical leads (not shown) for the coil are inserted through a passage in the dished housing, and the lifting magnet is operated by energizing the electrical coil 40 so that a magnetic field is established through pole shoe 32 and the periphery of the dished housing 12. If a magnet's coil is energized prior to being placed on a pile of scrap, it's lifting capacity of scrap is impaired. Typically therefore, the lifting magnet is deposited on a pile of scrap and the coil is then energized. A short time later, the precise period (referred to as the lag period) for establishing the field being a function of the design characteristics of the magnet, the magnet is lifted along with the load it has attracted and held; then the magnet is moved to a location at which the load is to be deposited, and the coil is de-energized. The load is released from the lifting magnet over a short period of time, the precise period for removing the field again being a function of the design characteristics of the magnet.

The total lag period in a lifting magnet is an exponential function of L/R, where L is inductance and R is resistance of the coil. The lag periods for establishing the field and removing the field are significant in a cycle comprising placing the magnet on a pile of scrap, energizing the coil, transporting the load on the magnet to a distally disposed location, deenergizing the coil, and returning the magnet to the pile of scrap. These lag periods become larger and are a function of the buildup of eddy currents in the central core and dished housing because eddy currents decrease the effective R. The larger the current used to energize the coil, the more significant is the buildup of eddy currents.

Figure 2:
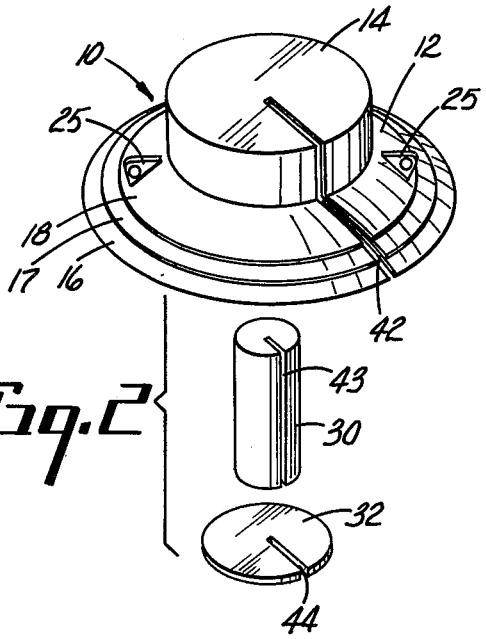
FIG. 2 is an exploded perspective view schematically illustrating a dome-shaped metal case and supporting structure for an internally cooled winding, and, more particularly, a radial slot or through-passage in the case and supporting structure, to damp eddy currents.

Referring now to FIG. 2 in which an exploded perspective view of the metal case 10 of FIG. 1 is diagrammatically illustrated, the dished housing 12 is provided with a radial through passage or slot 42 extending from near the center of the dished housing to near its periphery. The radial slot 42 is typically cut through the nested and welded dished shells 16, 17 and 18, preferably after the dished housing is stress relieved. Where this central core 30 is inserted in an axial passage in the dished housing, as shown in FIG. 1, the radial slot 42 is continued as a radial slot 43 provided in the central core. The slot 43 is radially aligned with slot 42. The slot 43 extends longitudinally for the entire length of the central core 30, and extends radially from near the longitudinal axis of the core 30 to it's periphery. The pole shoe 32 is provided with a radial slot 44 which extends from near the center of the pole shoe 32 to it's periphery, and is in registry with slot 43.

Where there is no axial passage in the dished housing 12, and the central core 30 is welded to the inner surface of the dished housing, at its center (as shown in FIG. 2), the radial slot 43 in the central core is in vertical registry with the slot 42. In either embodiment, the effect of the slots 42, 43 and 44 is to provide a spatial discontinuity. The combined slots 42, 43 and 44 produce the same effect as a single radial slot cut vertically into the fabricated metal case 10, starting from the periphery of the case and cutting towards the center along a radius. It will be recognized that it is not critical that the slot be cut linearly along a radius since the buildup of eddy currents would be negated by any spatial discontinuity or slot which started near the center and ended near the periphery of the metal case, irrespective of whether the slot was linear or not. For simplicity the term "radial slot" is used herein to describe a slot which commences near the center and terminates near the periphery of the metal case, including the central core and central pole shoe, regardless of the path of the slot therebetween.

Recognizing that, from a structural point of view, it is undesirable to provide a dished housing with a radial slot extending to the periphery, the slot may terminate a short distance from the periphery so as to leave sufficient peripheral stock to give the dished housing the desired strength. It is more preferred to provide the radial slot with a nonconducting material extending to the periphery and bridging the dished housing, on either side of the radial slot. The bridge so formed across the slot provides desirable structural reinforcement but inhibits flow of eddy currents thereacross. Suitable nonconducting reinforcing materials include fiber reinforced synthetic resinous materials, etc.

Figure 3:
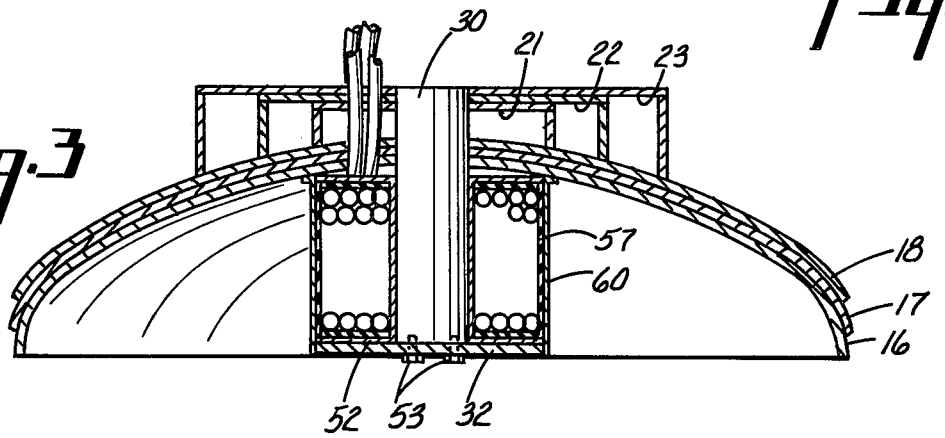
FIG. 3 is a front elevational view, in cross-section, in which is diagrammatically illustrated a fabricated dome-shaped metal case which houses an electrically continuous hollow conductor coil. The coil is wound on a mandrel or spool, and cooled by plural independent fluid streams within the coil. The coil is not sealed in the metal case.

Referring now to FIG. 3 there is diagrammatically illustrated a dome-shaped metal case 10 having a dished housing 12 and cap member 14 fabricated from plural nested arcuate shell members as described hereinabove and also illustrated in FIG. 1. Though a substantial weight saving is effected in the fabricated case, compared to a comparable, conventional, cast metal case, an even greater weight saving may be effected by substituting a hollow, cooled conductor for a solid wire electrical conductor and the support plate on which it rests. Accordingly, no support plate is provided, and the solid wire conductor is replaced with a coil, indicated generally by reference numeral 50, of hollow conductor wound in such a way that it permits flow of plural independent coolant streams through the conductor, yet presents an electrically continuous coil.

The coil 50 is preferably wound on a spool 52 which is removably disposed on central core 30. The spool 52 rests on central pole shoe 32 which is removably fastened to the central core 30 with fastening means, for example with Allen head machine bolts 53 recessed into central pole shoe 32 and threadedly secured in the central core 30.

Figure 4:
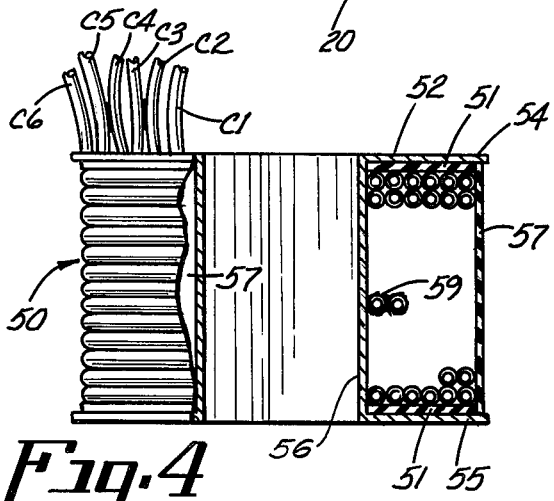
FIG. 4 is an elevational view, partially in cross section, and illustrating the independent flow of coolant through multiple, preselected coils of a hollow conductor which behaves electrically as a single coil.

Referring now to FIG. 4 there is diagrammatically illustrated in greater detail a coil 50 wound on a spool 52. The spool 52 has a radial upper flange 54 and a radial lower flange 55 extending outwardly from each end of a hollow cylindrical portion or hub 56. The inside diameter of the hub 56 is chosen so as to be slidably removably disposed on the central core 30. The coil 50 comprises plural helical cylindrical spirals of hollow conductor illustrated for simplicity as four coils C1, C2, C3 and C4. The hollow conductor may be of any shape but for convenience a cylindrical tube with an axial bore is used. A tube with a rectangular cross section and an axial bore is preferred for better packing. The hollow conductor is preferably of copper which is both flexible and a good conductor of heat and electricity although other conductors such as aluminum, which have lower conductivity, may be used. The conductor is preferably coated externally with a dielectric material 59 which is also flexible and ductile, such as known polymeric synthetic resinous materials, polyolefins, polyamides, and the like.

Coils C1 and C2 are formed from a continuous piece of hollow conductor which is wound tightly first around the hub to form coil C1, starting at the top and working downwards, in a cylindrical spiral. At the bottom of the central core, the conductor is wound to commence coil C2 which is tightly wound upwards in a cylindrical spiral. Coils C1 and C2 provide a continuous double cylindrical spiral fluid path for a coolant flowing therethrough. Coil C3 is formed from a second length of hollow conductor which is wound in a cylindrical spiral downwards, as was coil C1. At the bottom of the spiral, the conductor is wound upwards to commence coil C4, and forms a tight cylindrical spiral C4. Coils C3 and C4 provide a continuous fluid path independent of coils C1 and C2. The fluid path between coils C2 and C3 is interrupted and the coils are in fluid discontinuous relationship, one with another. Plural coils wound as just described may be manifolded to a source of coolant, incoming cool fluid entering coils C1 and C3 (as illustrated), and effluent warm fluid leaving through coils C2 and C4.

Figure 5:
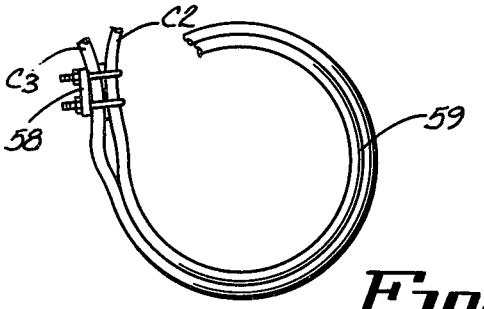
FIG. 5 is a detail plan view of a portion of the coil, schematically illustrating the manner in which multiple coils form an electrically continuous coil.

Referring now to FIG. 5 there is diagrammatically shown a detail of adjacent coils C2 and C3, wherein warm fluid leaves C2 and cool fluid enters C3. The electrical path between coils C2 and C3 is completed by an electrical conductor such as a brazed joint (as shown in FIG. 4) or bus bar clamp 58 thus placing all coils in the spool 52 in electrically continuous relationship with each other.

In an analogous manner, additional coils may be provided, with successive coils in fluid discontinuous relationship, but in electrically continuous relationship with each other. Coils are provided in continuous double cylindrical spirals to permit cool fluid to be introduced through a passage in the dome shaped metal case 10, and to permit warm fluid to be removed through a passage in the metal case. Where recovery of warmed fluid is not a consideration, single cylindrical spiral coils of hollow dielectric coated conductor may be used, and the warmed fluid may be discharged at the pole shoe 32. This may be desirable, where a cold disposable gas is used, such as for example air. It will be understood, that the single spiral coils will be in continuous electrically conductive relationship one with another so that all coils behave electrically as a single continuous coil.

It is preferred that the hollow spiral coils of hollow conductor be protected on the spool 52 by potting the coils in a dielectric elastomer 59 such as the family of silicone polymers commonly used for this purpose. In addition resilient pads 51 cushion both the top and bottom of the coil. Further, a cylinder of resilient material 57 cushions the surface of the coil. Finally, for protection against impact damage, the resilient cylinder 57 is sheathed with a cylinder of non-magnetic armor 60, which may be a non-conductor such as fiber reinforced synthetic resins, or architectural resins such as the family of polycarbonates such as, LEXAN and the like; or it may be a non-magnetic conductor such as brass, in which case it is also provided with a longitudinal electrical discontinuity to negate the buildup of eddy currents. The non-magnetic armor 60 is preferably affixed near its top to the inside surface of the inner shell 16 and, near its bottom, to the pole shoe 32. The coil 50 occupies a minor portion of the volume of the dished housing, preferably less than 25 percent of the space, and permits deep penetration of the magnetic flux lines to achieve maximum benefit of the volume of the dished housing for packing scrap material.

From a practical point of view, when using a cooled hollow coil having relatively few turns, it is essential that high voltage, low amperage power be delivered as close to the coil as possible because a heavy flexible conductor is difficult to handle on a crane or lifting boom. Therefore I choose to deliver high voltage, low ampherage AC current, typically 480 volts and less than 100 amps, in the immediate vicinity of the cap member upon which necessary electrical elements to convert the delivered alternating current into direct current, are conveniently mounted. This current may be delivered in any manner known to the art. For example an AC phase controller may be mounted near the operator who is distally removed from the lifting magnet. The AC phase controller is programmed to initially deliver a preselected relatively high voltage, which is a substantially higher effective voltage than that required to maintain the load on the magnet. This initial period may be in the range from about 1 second to about 10 seconds, but in any event less than the time required to overheat the cooled coil. After the initial period, the phase controller is programmed to reduce the effective current to a level sufficient to maintain maximum payload. The precise manner in which this simplified description of operation is optimally effectuated will be chosen by those skilled in the art in accordance with well-recognized electrical and thermal priniciples set forth in various handbooks, such as for example the SCR manuals published by General Electric Co., and form no part of this invention.

I claim:

1. In an electromagnet for lifting magnetizable material, said electromagnet having an electrical winding connected to a power source, said winding being disposed on a central core, and a dome-shaped metal case within which said electrical winding is disposed, the improvement comprising said dome-shaped metal case including plural arcuate steel shells in nesting relationship one with another each of said shells being in unimpeded magnetic communication with the other shells, and with said central core, said dome-shaped metal case and said central core having a radial slot extending from near the center of said core and longitudinally therethrough, to near the periplery of said dome-shaped metal case.

2. In an electromagnet for lifting magnetizable material, said electromagnet having an electrical winding connected to a power source, said winding being disposed on a central core, and a dome-shaped metal case within which said electrical winding is disposed, the improvement comprising said dome-shaped metal case including plural arcuate steel shells in nesting relationship one with another each of said shells being in unimpeded magnetic communication with the other shells, and with said central core; said dome-shaped metal case comprising a dished housing, and a cap member structurally and magnetically reinforcing said dished housing; said dished housing including plural dished shells in nesting relationship one with another; said cap member including plural cap elements in nesting relationship one with another; each of said dished shells and each of said cap elements being in unimpeded magnetic communication with the others, and also with said central core.

3. The electromagnet of claim 2 wherein said periphery of said innermost dished shell includes a wear-resistant coating bonded to said innermost dished shell.

4. The electromagnet of claim 2 wherein said cap elements include an innermost cap element, an outermost cap element, and at least one intermediate cap element, said cap elements being in stepped relationship with one and another within said cap member, said cap member having its maximum thickness near its longitudinal axis and its minimum thickness near the periphery of said cap member.

5. The electromagnet of claim 2 wherein said dome-shaped metal case and said central core are provided with a radial slot extending from near the center of said core and longitudinally therethrough, and through said cap member and said dished housing, to near the periphery of said dished housing, said radial slot providing an electrical discontinuity in said core, cap member and dished housing to prevent the buildup of eddy currents.

6. In an electromagnet for lifting magnetizable material, said electromagnet having an electrical winding connected to a power source, said winding being disposed on a central core, and a dome-shaped metal case within which said electrical winding is disposed, the improvement comprising an electrically continuous winding having plural helical cylindrical coils of insulated conductor having an axial bore, through each of which coils an independent stream of coolant is to be flowed, and, a spool removably disposed upon said central core, said coils being tightly spirally wound coaxially on said spool; said dome-shaped metal case comprising plural arcuate steel shells in nesting relationship one with another, each of said shells being in unimpeded magnetic communication with the other shells, and with said central core.

7. The electromagnet of claim 6 wherein said dome-shaped metal case comprises a dished housing, and a cap member structurally and magnetically reinforcing said dished housing; said dished housing including plural dished shells in nesting relationship one with another; said cap member including plural cap elements in nesting relationship one with one another; each of said dished shells and each of said cap elements being in unimpeded magnetic communication with the others, and also with said central core.

8. The electromagnet of claim 7 wherein said coils on said spool, disposed upon said central core, occupy less than 25 percent by volume of the volume of said dished housing.

9. The electromagnet of claim 8 wherein said dome-shaped metal case and said central core are provided with a radial slot extending from near the center of said core and longitudinally therethrough, and through said dome-shaped metal case to near the periphery thereof, said radial slot providing an electrical discontinuity in said core and dome-shaped metal case, to prevent the buildup of eddy currents.

* * * * *